US011175038B2

(12) United States Patent
Fox et al.

(10) Patent No.: US 11,175,038 B2
(45) Date of Patent: Nov. 16, 2021

(54) GAS VALVE BRACKET

(71) Applicant: Haier US Appliance Solutions, Inc., Wilmington, DE (US)

(72) Inventors: Steven Fox, Louisville, KY (US); Joshua Adam Mayne, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/743,458

(22) Filed: Jan. 15, 2020

(65) Prior Publication Data

US 2021/0215339 A1 Jul. 15, 2021

(51) Int. Cl.

| | |
|---|---|
| ***F23N 1/00*** | (2006.01) |
| ***F24C 3/12*** | (2006.01) |
| ***F24C 3/08*** | (2006.01) |

(52) U.S. Cl.

CPC ..... *F23N 1/007* (2013.01); *F24C 3/085* (2013.01); *F24C 3/12* (2013.01)

(58) Field of Classification Search

CPC .. F23C 3/12; F23C 3/122; F23C 3/126; F23N 1/007; F23N 1/085; F23N 1/12; F24C 3/12; F24C 3/126; F24C 3/085; F24C 3/124

USPC ..... 126/39 N, 39 R, 39 E

See application file for complete search history.

(56) References Cited

U.S. PATENT DOCUMENTS

| | | | | |
|---|---|---|---|---|
| 4,342,886 | A | 8/1982 | Demi | |
| 4,921,161 | A * | 5/1990 | Genbauffe | F23N 5/067 236/15 A |
| 7,490,628 | B2 | 2/2009 | Frost et al. | |
| 9,976,749 | B2 | 5/2018 | Yang et al. | |
| 2015/0323191 | A1* | 11/2015 | Yang | H01H 13/14 126/42 |
| 2017/0314720 | A1* | 11/2017 | Iturbe Arriola | F16L 55/07 |
| 2017/0350601 | A1 | 12/2017 | Beghi et al. | |

FOREIGN PATENT DOCUMENTS

WO WO2001073326 A1 10/2001

* cited by examiner

*Primary Examiner* — Vivek K Shirsat
(74) *Attorney, Agent, or Firm* — Dority & Manning, P.A.

(57) ABSTRACT

A gas cooktop appliance includes a control panel and a fuel supply line. A gas valve is positioned on the fuel supply line. A bracket includes a top bracket portion extending over a top of the fuel supply line. A bottom bracket portion extends under a bottom of the fuel supply line. The bottom bracket portion is mounted to the top bracket portion. A mounting flange is connected to one or both of the top and bottom bracket portions. The mounting flange is positioned at and attached to a rear surface of the control panel that faces the fuel supply line and the gas valve.

18 Claims, 10 Drawing Sheets

GAS VALVE BRACKET

FIELD OF THE INVENTION

The present subject matter relates generally to gas valve brackets.

BACKGROUND OF THE INVENTION

Gas cooktop appliances can include a plurality of gas burners on a top panel. Combustion of fuel at the gas burners heats pots, pans, griddles, etc. To regulate fuel flow to the gas burners, known gas burners are connected to a valve with a knob. A user turns the knob to regulate fuel flow to the associated gas burner.

Mounting valves within cooktop appliances can problematic. For instance, an ignition switch of the valve can require servicing, and accessing the ignition switch in known cooktop appliances is difficult. A technician is generally required to remove the valve from a fuel manifold in order to access the ignition switch. This process is time consuming and can require specific tools.

BRIEF DESCRIPTION OF THE INVENTION

Aspects and advantages of the invention will be set forth in part in the following description, or may be apparent from the description, or may be learned through practice of the invention.

In an example embodiment, a gas cooktop appliance includes a control panel and a fuel supply line. A gas valve is positioned on the fuel supply line. A bracket includes a top bracket portion extending over a top of the fuel supply line. A bottom bracket portion extends under a bottom of the fuel supply line. The bottom bracket portion is mounted to the top bracket portion. A mounting flange is connected to one or both of the top and bottom bracket portions. The mounting flange is positioned at and attached to a rear surface of the control panel that faces the fuel supply line and the gas valve.

In an example aspect, the bottom bracket portion includes a rear wall defining a slot. A body of the gas valve is positioned within the slot.

In an example aspect, the bottom bracket portion includes a front wall with a pair of support posts. A cap of the gas valve is positioned on the pair of support posts.

In an example aspect, the top bracket portion includes a pair of mounting arms. The bottom bracket portion includes a pair of mounting arms. The pair of mounting arms of the top bracket portion are snap-fit to the pair of mounting arms of the bottom bracket portion.

In an example aspect, a clip of each of the pair of mounting arms of the bottom bracket portion is received within a respective slot of the pair of mounting arms of the top bracket portion.

In an example aspect, the mounting flange extends from the top bracket portion to the control panel.

In an example aspect, the mounting flange includes a first wall extending from the top bracket portion towards the control panel. A second wall is positioned at and attached to the rear surface of the control panel. The first wall is oriented at an angle relative to the second wall. The angle is no less than eighty degrees (80°) and no greater than one hundred and fifty degrees (150°).

In an example aspect, the second wall defines a slot. A stem of the gas valve extends through the slot of the second wall.

In an example aspect, the second wall is fastened to the control panel.

In an example aspect, a top wall of the top bracket portion defines an opening. The gas valve is mounted to the fuel supply line with a fastener that extends through the fuel supply line to the gas valve. A head of the fastener is positioned within the opening.

In an example aspect, a rear wall of the top bracket portion is positioned on a rear wall of the bottom bracket portion.

In an example aspect, the gas valve is mounted to the fuel supply line with a fastener that extends through the fuel supply line to the gas valve.

In an example aspect, the gas valve is positioned on a bottom of the fuel supply line.

In an example aspect, the fuel supply line has a rectangular cross-section along a length of the fuel supply line.

Each of the example aspects recited above may be combined with one or more of the other example aspects recited above in certain embodiments. For instance, all of the thirteen example aspects recited above may be combined with one another in some embodiments. As another example, any combination of two, three, four, five, or more of the thirteen example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
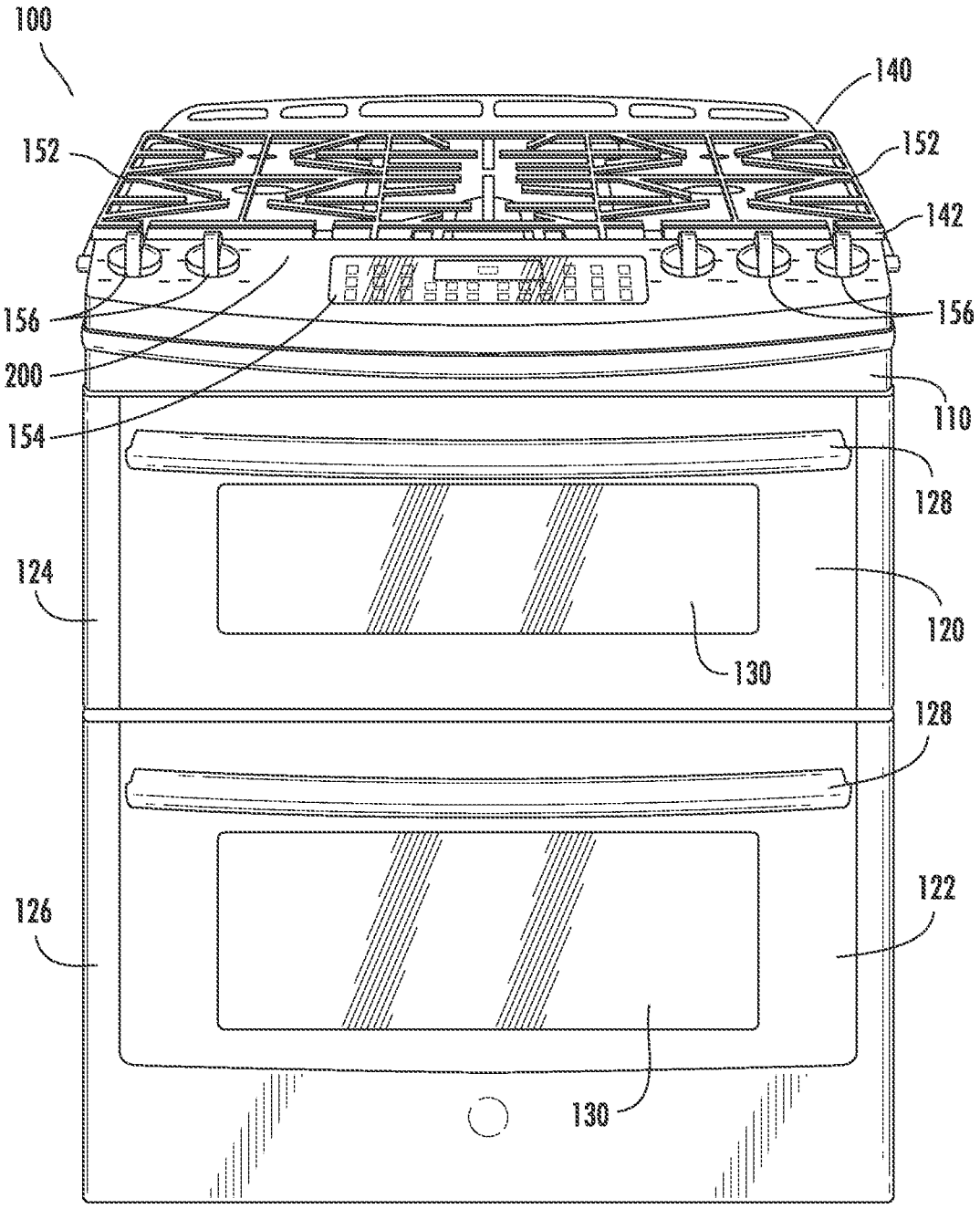
FIG. 1 is a front, perspective view of a range appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
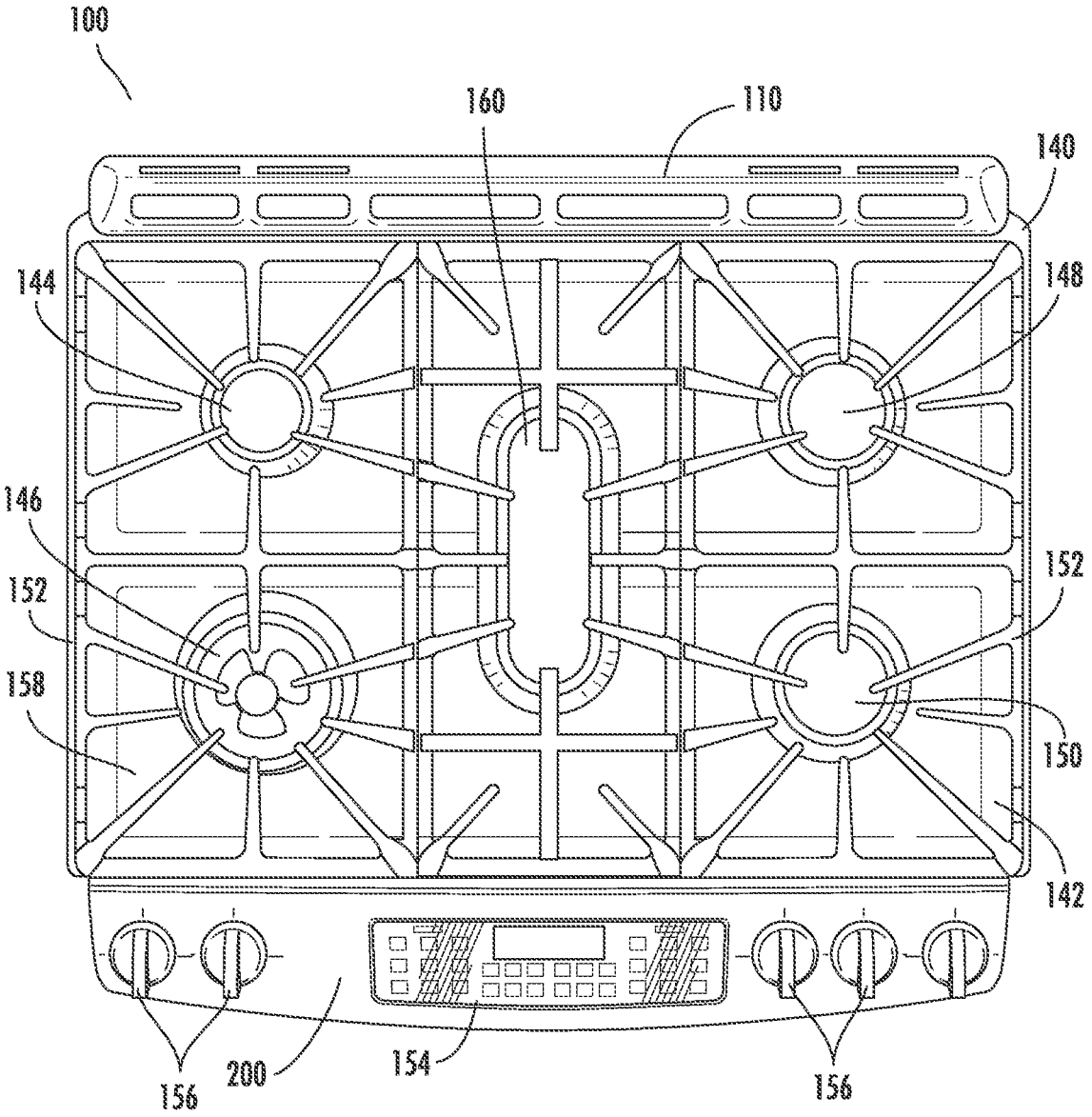
FIG. 2 is a top, plan view of the example range appliance of FIG. 1.

FIG. 1 is a front, perspective view of a range appliance 100 as may be employed with the present subject matter. FIG. 2 is a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
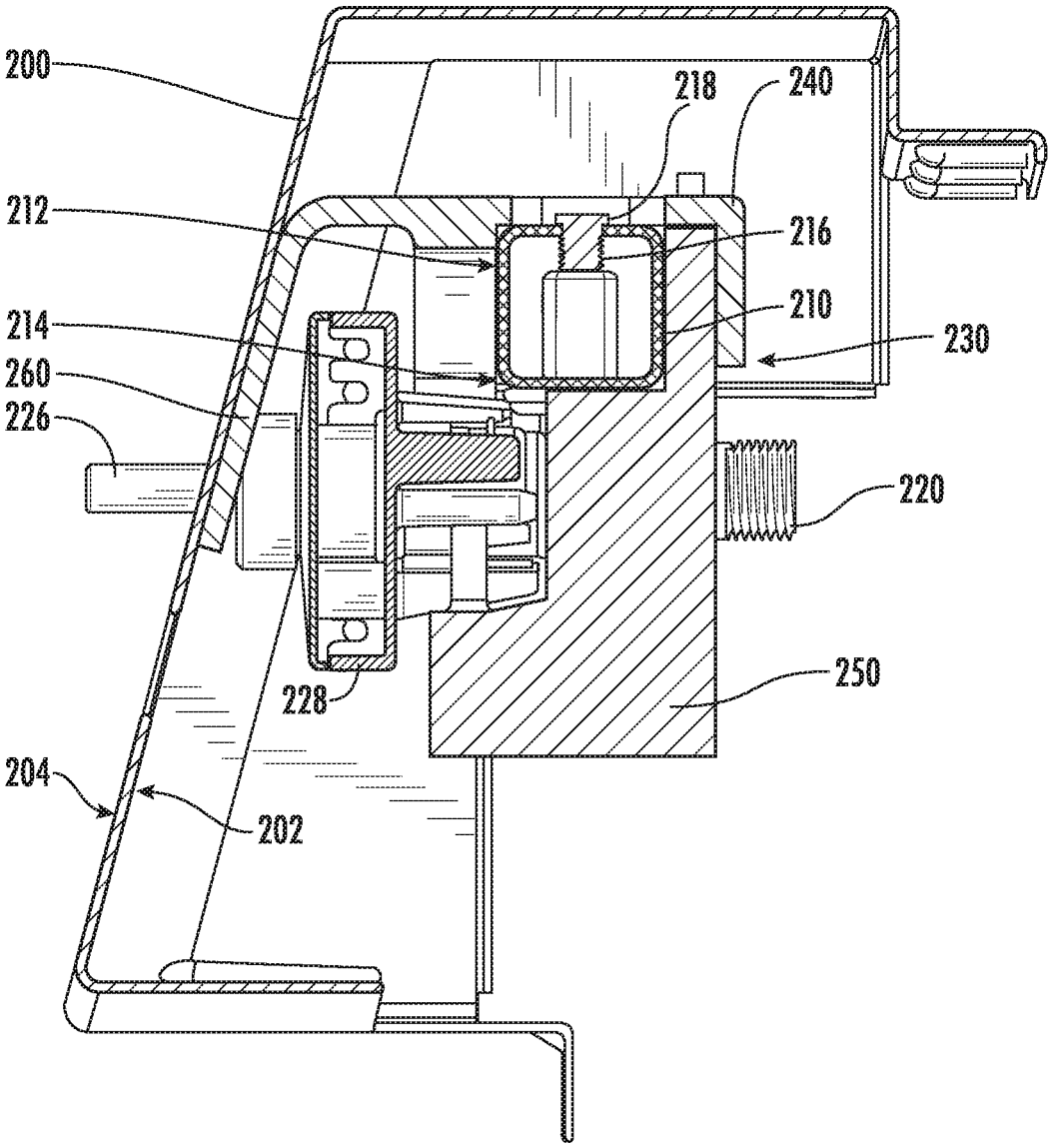
FIG. 3 is a partial, section view of a control panel of the example range appliance of FIG. 1.
Figure 4:
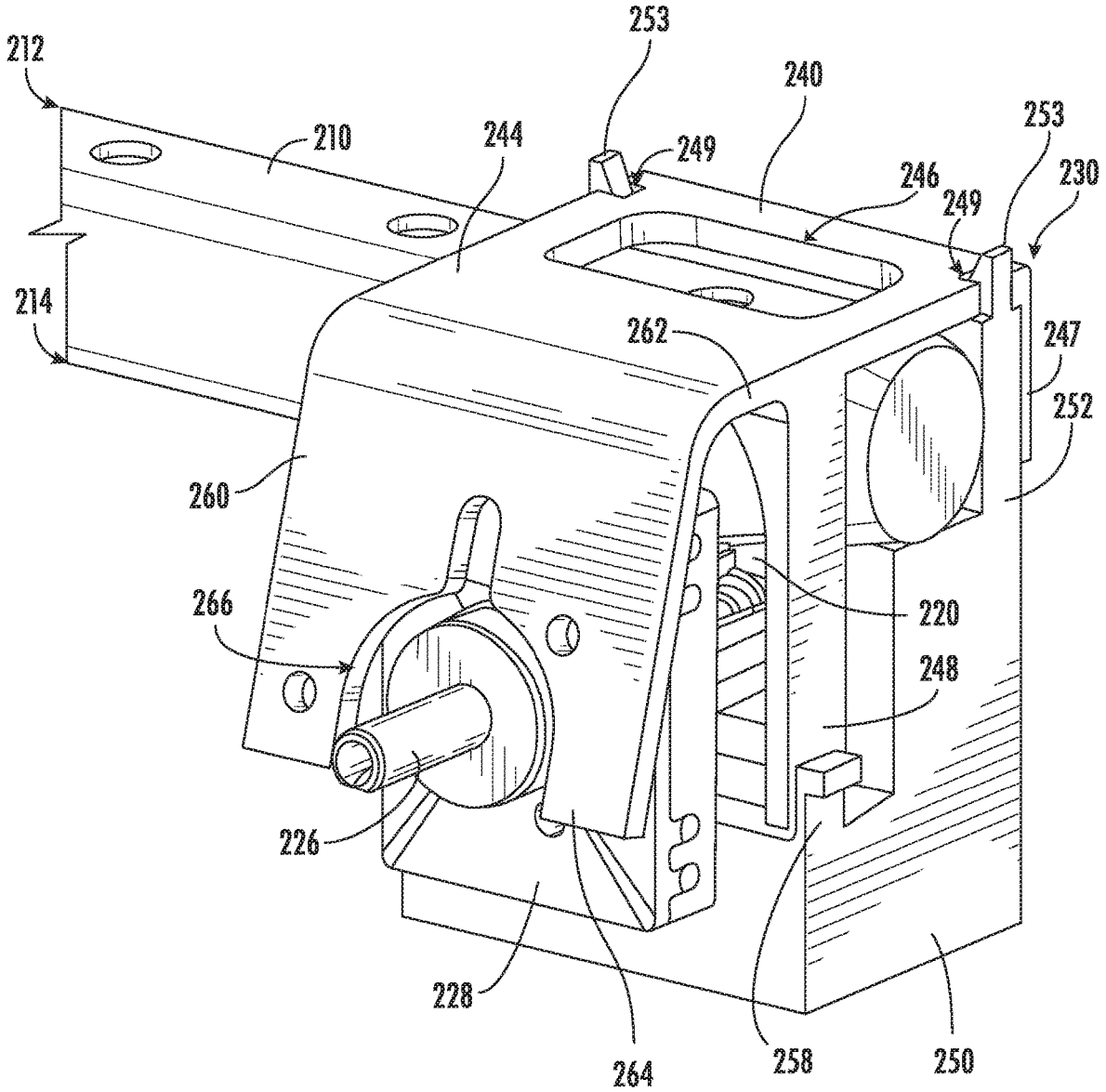
FIG. 4 is a perspective view of a gas valve, a bracket, and a fuel supply line of the example range appliance of FIG. 1.
Figure 5:
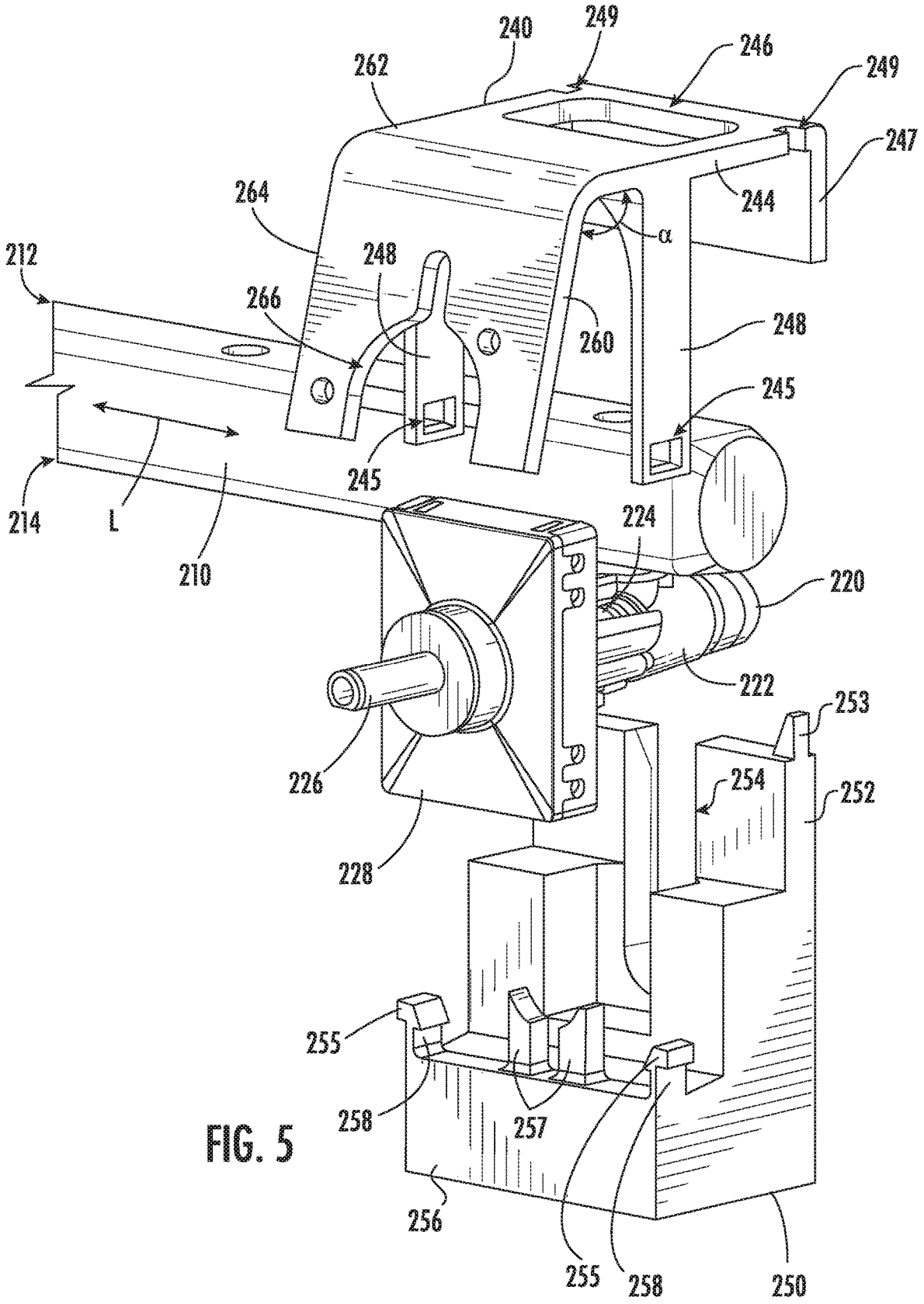
FIG. 5 is an exploded view of the gas valve, the bracket, and the fuel supply of FIG. 4.
Figure 6:
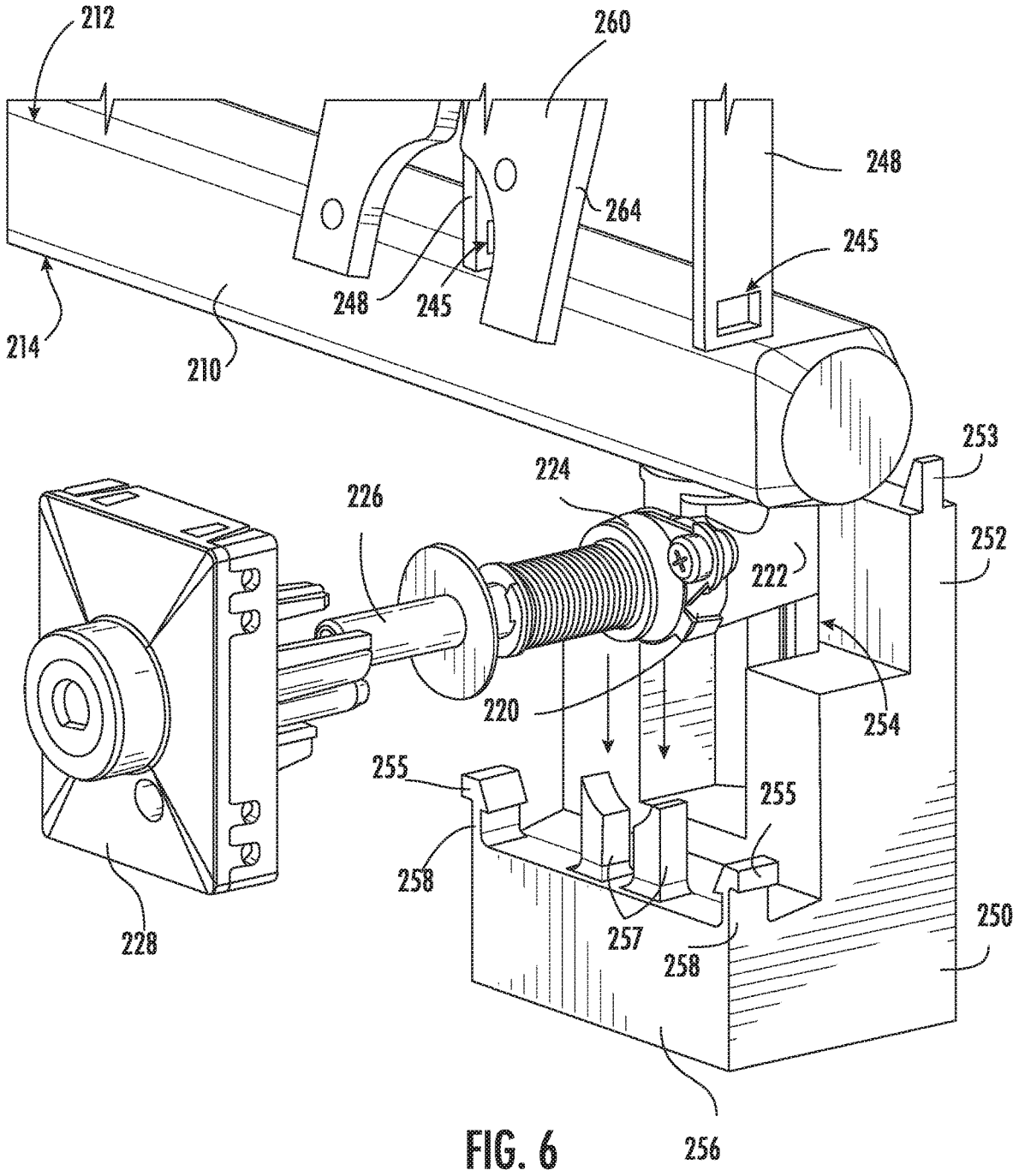
FIG. 6 is a front, exploded view of the gas valve, the bracket, and the fuel supply of FIG. 4.
Figure 7:
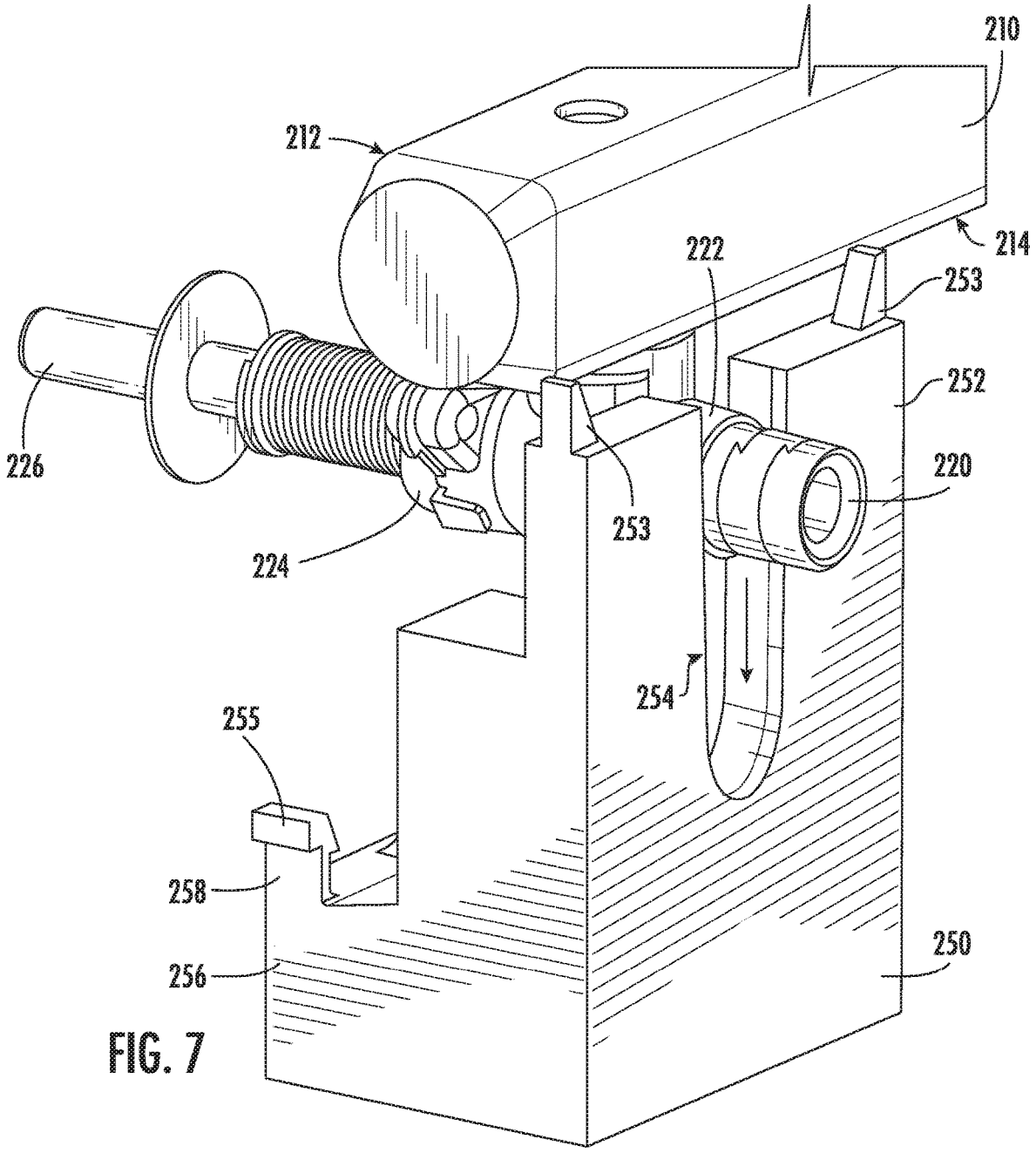
FIG. 7 is a rear, exploded view of the gas valve, the bracket, and the fuel supply of FIG. 4.

FIG. 3 is a partial, section view of a control panel 200 of range appliance 100. Control panel 200 may have an inner or rear surface 202 and an outer or front surface 204, e.g., that are positioned opposite each other on control panel 200. For instance, inner surface 202 of control panel 200 may face an interior 112 of cabinet 110, and outer surface 204 of control panel 200 may face away from interior 112 of cabinet 110. Control panel 200 may be a piece of sheet metal in certain example embodiments. For example, control panel 200 may be stainless steel sheet, an enabled steel sheet, etc.

With reference to FIGS. 3 through 7, control panel 200 may cover various interior components of range appliance 100. For example, a fuel supply line 210 and a gas valve 220 may be positioned behind control panel 200 within cabinet 110. Thus, inner surface 202 of control panel 200 may face fuel supply line 210 and gas valve 220. Control panel 200 may limit or block access to the various interior components of range appliance 100. However, certain components may pass through control panel 200 to be accessible, e.g., at outer surface 204 of control panel 200, as discussed in greater detail below.

Fuel supply line 210 may be connected to a source of pressurized gaseous fuel, such as a propane tank or a natural gas line. Thus, gaseous fuel from the pressurized gaseous fuel source may flow through fuel supply line 210 to burner assemblies 144, 146, 148, 150 on top panel 142 (FIG. 2). In certain example embodiments, fuel supply line 210 has a rectangular cross-section along a length L (FIG. 5) of fuel supply line 210.

Gas valve 220 may be positioned on and coupled to fuel supply line 210. For instance, gas valve 220 may be positioned on a bottom 214 of fuel supply line 210. Gas valve 220 may be mounted to fuel supply line 210 with a fastener 216 (FIG. 3) that extends through fuel supply line 210 to gas valve 220. Thus, fastener 216 may be threaded to one or both of fuel supply line 210 and gas valve 220.

Gas valve 220 may regulate a flow of gaseous fuel from fuel supply line 210 to a respective one of burner assemblies 144, 146, 148, 150. Thus, e.g., a user may adjust gas valve 220 to modify a flow rate of gaseous fuel from fuel supply line 210 to a respective one of burner assemblies 144, 146, 148, 150. Gas valve 220 may be a manual control valve with a body 222, a cap 224, and a stem 226. Stem 226 may be connected or mounted to a plug, ball, etc. within body 222. When stem 226 rotates, the plug, ball, etc. within body 222 also rotates to regulate gaseous fuel through body 222. Cap 224 is mounted to body 222 to hold the plug, ball, etc. within body 222. Stem 226 may extend through control panel 200, and stem 226 may be connected to a knob 156 (FIG. 1), e.g., at outer surface 204 of control panel 200, such that a user may rotates stem 226 to actuate gas valve 220. An ignition switch 228 may be connected to stem 226.

A bracket 230 may connect control panel 200 and gas valve 220. Bracket 230 may include a top bracket portion 240 and bottom bracket portion 250. Top bracket portion 240 may extend over a top 212 of fuel supply line 210, and bottom bracket portion 250 may extend under bottom 214 of fuel supply line 210. Bottom bracket portion 250 may be mounted top bracket portion 240. Thus, e.g., bracket 230 may encapsulate gas valve 220. In particular, top and bottom bracket portions 240, 250 may extend around fuel supply line 210 and/or gas valve 220, e.g., in a plane that is perpendicular to the length L of fuel supply line 210.

Top and bottom bracket portions 240, 250 may be connect to each other in a suitable manner. As an example, top bracket portion 240 may include a pair of mounting arms 248. Bottom bracket portion 250 may also include a pair of mounting arms 258. Mounting arms 248 of top bracket portion 240 may engage with or connect to mounting arms 258 of bottom bracket portion 250. For example, mounting arms 248 of top bracket portion 240 may snap-fit to mounting arms 258 of bottom bracket portion 250. In certain example embodiments, mounting arms 258 of bottom bracket portion 250 may include clips 255, and mounting arms 248 of top bracket portion 240 may define slots 245. Each clip 255 of bottom bracket portion 250 may be received within a respective slot 245 of top bracket portion 240.

To assist with securely connecting gas valve 220 to bracket 230. Bracket 230 may contact a bottom of gas valve 220 and/or a rear of gas valve 220. For instance, bottom bracket portion 250 may include a rear wall 252. Rear wall 252 of bottom bracket portion 250 may define a slot 254. Body 222 of gas valve 220 may be positioned within slot 254. As an example, slot 254 may be open at a top of rear wall 252, and gas valve 220 may be inserted into slot 254 at the top of rear wall 252 and slide within slot 254 until body 222 of gas valve 220 contacts rear wall 252 at the bottom of slot 254. As another example, bottom bracket portion 250 may include a front wall 256 with a pair of support posts 257. Cap 224 of gas valve 220 may be positioned on support posts 257. As may be seen from the above, slot 254 and support posts 257 may cooperate to form an interface between gas valve 220 and bracket 230.

As noted above, bracket 230 may connect control panel 200 and gas valve 220. Thus, bracket 230 may include a mounting flange 260. Mounting flange 260 is connected to one or both of top and bottom bracket portions 240, 250. Mounting flange 260 may also be positioned at and attached to control panel 200, e.g., at rear surface 202 of control panel 200. For instance, fasteners, such as screws, may extend through control panel 200 into mounting flange 260 to couple bracket 230 to control panel 200. A head of such fasteners may be positioned on front surface 204 of control panel 200.

In certain example embodiments, mounting flange 260 extends from top bracket portion 240 to control panel 200. Thus, e.g., mounting flange 260 may be integrally formed with top bracket portion 240. In particular, mounting flange 260 and top bracket portion 240 may be formed from single, unitary piece of material, such as injection molded plastic. Mounting flange 260 may include a first wall 262 and a second wall 264. First wall 262 may extend from top bracket portion 240 towards control panel 200. Second wall 264 may be positioned at and attached to rear surface 202 of control panel 200. For example, second wall 264 may be fastened to control panel 200.

First wall 262 may be oriented at an angle, a, (FIG. 5) relative to second wall 264. The angle $\alpha$ may be no less than eighty degrees (80°) and no greater than one hundred and fifty degrees (150°). As an example, the angle $\alpha$ may be about one hundred and twenty degrees (120°). As used herein, the term "about" means within ten degrees of the stated angle when used in the context of angles. Second wall 264 may define a slot 266, and stem 226 of gas valve 220 may extend through slot 266 of second wall 264.

As noted above, fastener 216 may couple gas valve 220 to fuel supply line 210. In certain example embodiments, a top wall 244 of top bracket portion 240 defines an opening 246. Top wall 244 may be positioned on fuel supply line 210, and a head 218 of fastener 216 may be is positioned within opening 246.

To assist with connecting top and bottom bracket portions 240, 250, a rear wall 247 of top bracket portion 240 may be positioned on rear wall 252 of bottom bracket portion 250. Interference between rear walls 247, 252 of top and bottom bracket portions 240, 250 may limit movement of top and bottom bracket portions 240, 250 relative to each other. A pair of posts 253 of rear wall 252 of bottom bracket portion 250 may be received within a pair of slots 249 of rear wall 247 of top bracket portion 240. Interference between posts 253 and rear wall 247 at slots 249 may further assist with limiting movement of top and bottom bracket portions 240, 250 relative to each other.

Utilizing bracket 230 to connect control panel 200 and gas valve 220 has numerous advantages over known mounting systems. For instance, bracket 230 may allow replacement or servicing of ignition switch 228 without requiring removal of gas valve 220 from fuel supply line 210. Thus, e.g., a service technician may remove the fasteners that extend through control panel 200 into mounting flange 260 in order to disconnect bracket 230 from control panel 200. The service technician may then disconnect bottom bracket portion 250 from top bracket portion 250 and remove bracket 230 from around gas valve 210, e.g., by releasing the snap-fit connection between top and bottom bracket portions 240, 250. The service technician may then replace or service ignition switch 228, e.g., while gas valve 220 remains connected to fuel supply line 210 with fastener 216.

Figure 8:
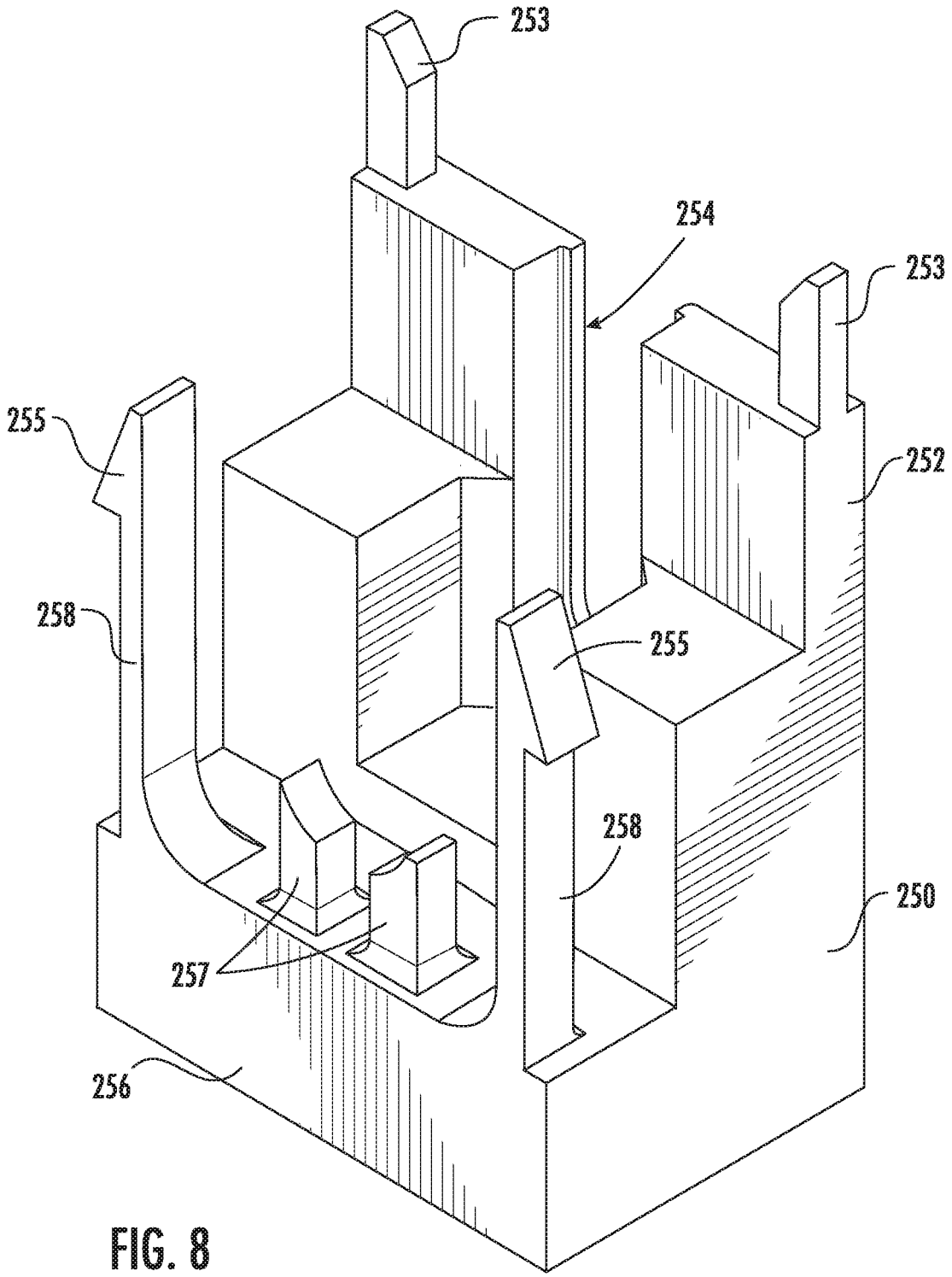
FIGS. 8 and 9 are perspective views of a bottom bracket portion and a top bracket portion of a bracket according to an example embodiment of the present subject matter.
Figure 9:
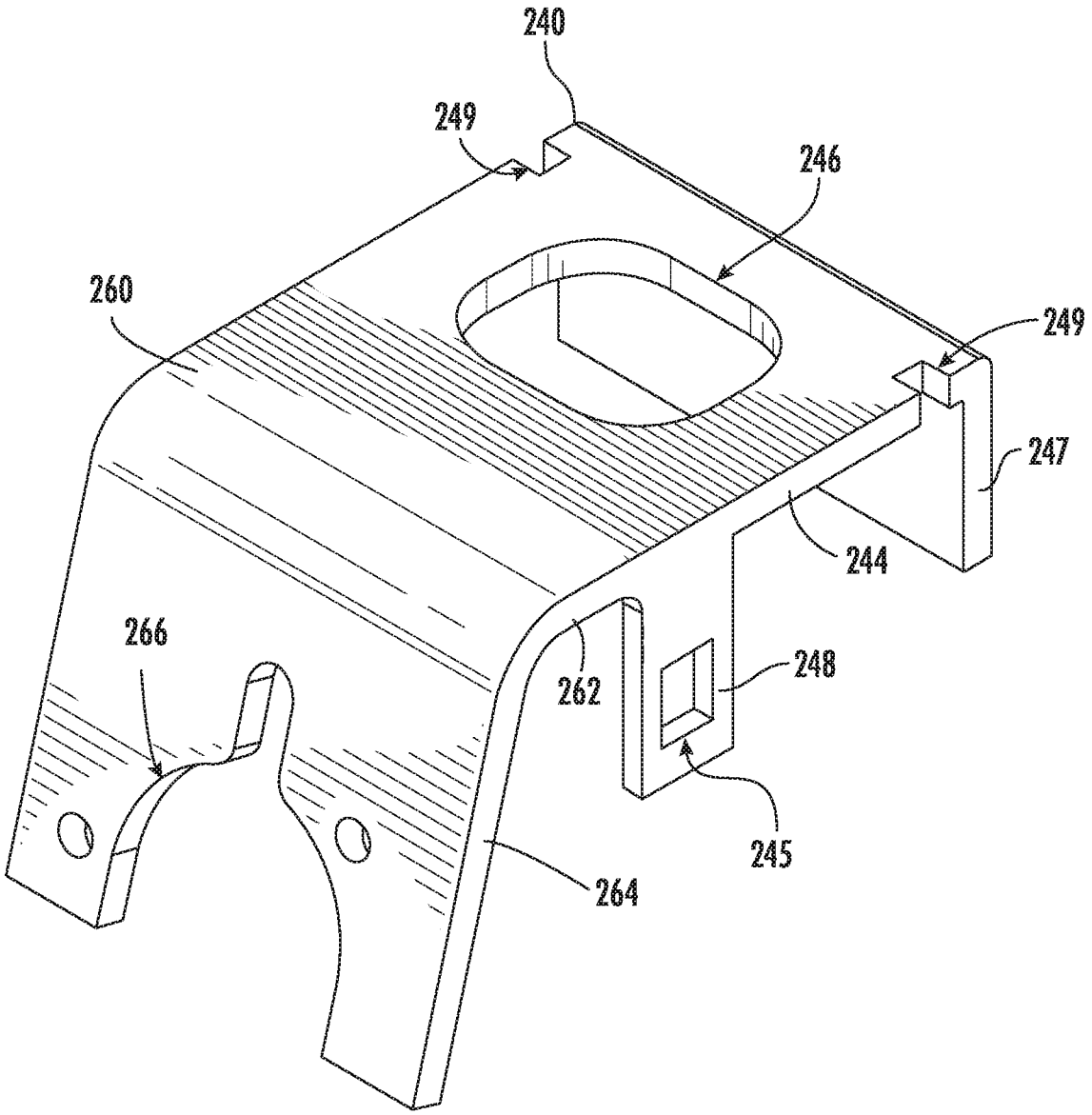
Figure 10:
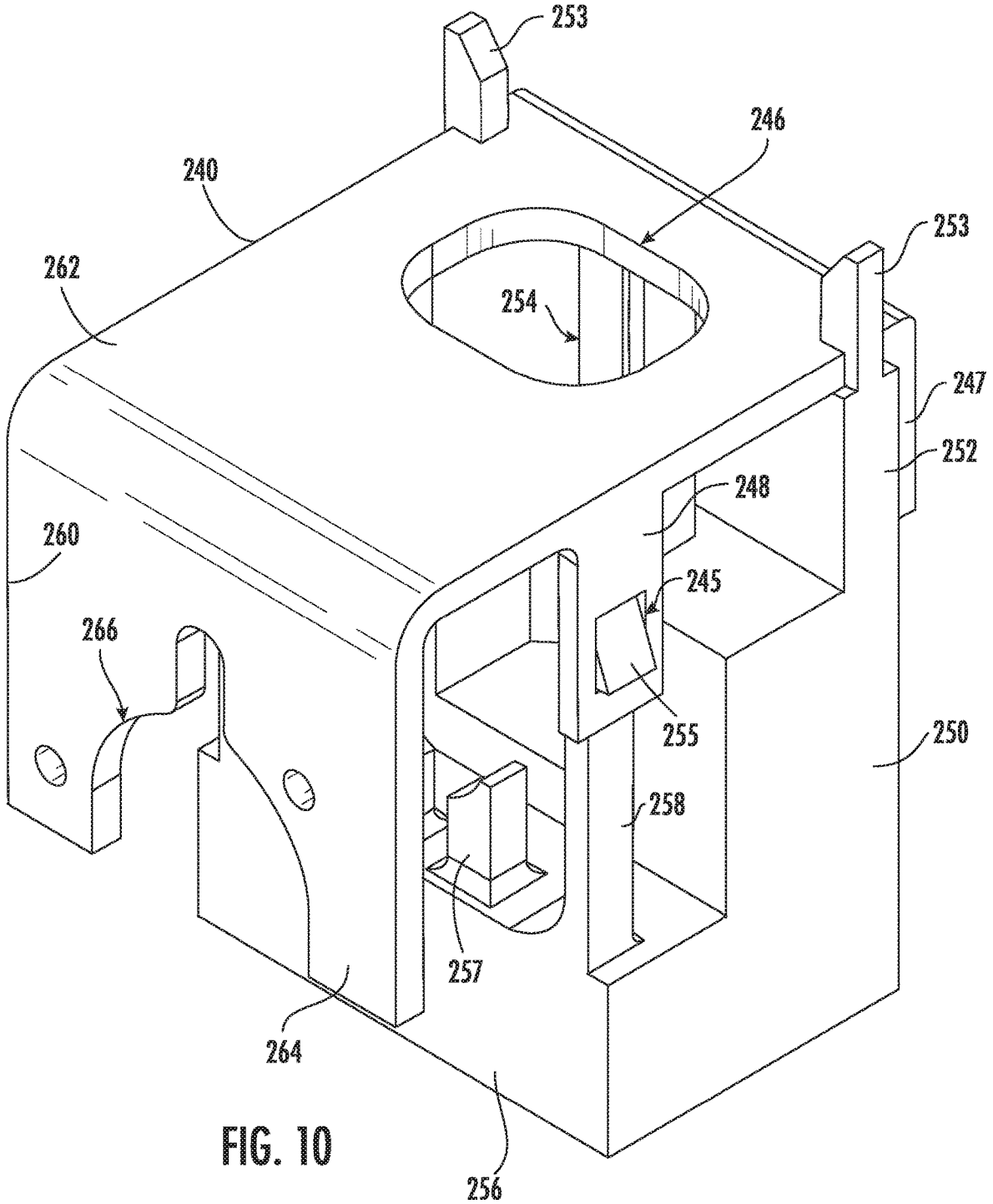
FIG. 10 is a perspective view of a bracket according to an example embodiment of the present subject matter.

FIGS. 8 and 9 are perspective views of bottom and top bracket portions 240, 250 according to an example embodiment. In FIGS. 8 and 9, the arrangement of clips 255 and slots 245 is adjusted. In particular, mounting arms 248 of top bracket portion 240 are shorter than mounting arms 258 of bottom bracket portion 250. FIG. 10 is a perspective view of bracket 200 according to another example embodiment. The angle $\alpha$ is about ninety degrees (90°). As may be seen from the above, the particular arrangement of components in bracket 230 may be modified, e.g., to the particular arrangement required by an appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas cooktop appliance, comprising:

a control panel;

a fuel supply line;

a gas valve positioned on the fuel supply line; and a bracket comprising a top bracket portion extending over a top of the fuel supply line;

a bottom bracket portion extending under a bottom of the fuel supply line, the bottom bracket portion mounted to the top bracket portion; and a mounting flange connected to one or both of the top and bottom bracket portions, the mounting flange positioned at and attached to a rear surface of the control panel that faces the fuel supply line and the gas valve, wherein the bottom bracket portion comprises a rear wall defining a slot, a body of the gas valve positioned within the slot, and wherein the bottom bracket portion comprises a front wall with a pair of support posts, a cap of the gas valve positioned on the pair of support posts.

2. The gas cooktop appliance of claim 1, wherein the top bracket portion comprises a pair of mounting arms, the bottom bracket portion comprises a pair of mounting arms, and the pair of mounting arms of the top bracket portion snap-fit to the pair of mounting arms of the bottom bracket portion.

3. The gas cooktop appliance of claim 2, wherein a clip of each of the pair of mounting arms of the bottom bracket portion is received within a respective slot of the pair of mounting arms of the top bracket portion.

4. The gas cooktop appliance of claim 1, wherein the mounting flange extends from the top bracket portion to the control panel.

5. The gas cooktop appliance of claim 1, wherein the mounting flange comprises:

a first wall extending from the top bracket portion towards the control panel; and a second wall positioned at and attached to the rear surface of the control panel, wherein the first wall is oriented at an angle relative to the second wall, the angle being no less than eighty degrees and no greater than one hundred and fifty degrees.

6. The gas cooktop appliance of claim 5, wherein the second wall defines a slot, and a stem of the gas valve extends through the slot of the second wall.

7. The gas cooktop appliance of claim 5, wherein the second wall is fastened to the control panel.

8. The gas cooktop appliance of claim 1, wherein a top wall of the top bracket portion defines an opening, the gas valve is mounted to the fuel supply line with a fastener that extends through the fuel supply line to the gas valve, and a head of the fastener is positioned within the opening.

9. The gas cooktop appliance of claim 8, wherein a rear wall of the top bracket portion is positioned on a rear wall of the bottom bracket portion.

10. The gas cooktop appliance of claim 1, wherein the gas valve is mounted to the fuel supply line with a fastener that extends through the fuel supply line to the gas valve.

11. The gas cooktop appliance of claim 10, wherein the gas valve is positioned on a bottom of the fuel supply line.

12. The gas cooktop appliance of claim 1, wherein the fuel supply line has a rectangular cross-section along a length of the fuel supply line.

13. A gas cooktop appliance, comprising:

a control panel;

a fuel supply line having a rectangular cross-section along a length of the fuel supply line;

a gas valve positioned on the fuel supply line at a bottom of the fuel supply line;

a fastener extending through the fuel supply line to the gas valve; and a bracket comprising a top bracket portion extending over a top of the fuel supply line;

a bottom bracket portion extending under a bottom of the fuel supply line, the bottom bracket portion mounted to the top bracket portion; and a mounting flange connected to one or both of the top and bottom bracket portions, the mounting flange positioned at and attached to a rear surface of the control panel that faces the fuel supply line and the gas valve, wherein a top wall of the top bracket portion defines an opening, and a head of the fastener is positioned within the opening.

14. The gas cooktop appliance of claim 13, wherein the bottom bracket portion comprises a rear wall and a front wall, a body of the gas valve positioned within a slot of the rear wall, a cap of the gas valve positioned on a pair of support posts of the front wall.

15. The gas cooktop appliance of claim 13, wherein the top bracket portion comprises a pair of mounting arms, the bottom bracket portion comprises a pair of mounting arms, and the pair of mounting arms of the top bracket portion snap-fit to the pair of mounting arms of the bottom bracket portion.

16. The gas cooktop appliance of claim 15, wherein a clip of each of the pair of mounting arms of the bottom bracket portion is received within a respective slot of the pair of mounting arms of the top bracket portion.

17. The gas cooktop appliance of claim 13, wherein the mounting flange comprises:

a first wall extending from the top bracket portion towards the control panel; and a second wall positioned at and attached to the rear surface of the control panel, wherein the first wall is oriented at an angle relative to the second wall, the angle is no less than eighty degrees and no greater than one hundred and fifty degrees, the second wall defines a slot, a stem of the gas valve extends through the slot of the second wall, and the second wall is fastened to the control panel.

18. A gas cooktop appliance, comprising:

a control panel;

a fuel supply line;

a gas valve positioned on the fuel supply line; and a bracket comprising a top bracket portion extending over a top of the fuel supply line;

a bottom bracket portion extending under a bottom of the fuel supply line, the bottom bracket portion mounted to the top bracket portion; and a mounting flange connected to one or both of the top and bottom bracket portions, the mounting flange positioned at and attached to a rear surface of the control panel that faces the fuel supply line and the gas valve, wherein the top bracket portion comprises a pair of mounting arms, the bottom bracket portion comprises a pair of mounting arms, and the pair of mounting arms of the top bracket portion snap-fit to the pair of mounting arms of the bottom bracket portion, and wherein a clip of each of the pair of mounting arms of the bottom bracket portion is received within a respective slot of the pair of mounting arms of the top bracket portion.

* * * * *